US006041127A

United States Patent [19]

Elko

[11] Patent Number: 6,041,127

[45] **Date of Patent: *Mar. 21, 2000**

[54] STEERABLE AND VARIABLE FIRST-ORDER DIFFERENTIAL MICROPHONE ARRAY

[75] Inventor: Gary Wayne Elko, Summit, N.J.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/832,553

[22] Filed: Apr. 3, 1997

[51] Int. Cl.[7] ..... H04R 3/00

[52] U.S. Cl. ..... 381/92; 381/66

[58] Field of Search ..... 381/92, 66, 94.1, 381/94.7

[56] References Cited

U.S. PATENT DOCUMENTS

| | | | |
|---|---|---|---|
| 3,824,342 | 7/1974 | Christensen et al. . | |
| 4,042,779 | 8/1977 | Craven et al. . | |
| 4,536,887 | 8/1985 | Kaneda et al. . | |
| 4,703,506 | 10/1987 | Sakamoto et al. . | |
| 4,741,038 | 4/1988 | Elko et al. . | |
| 4,752,961 | 6/1988 | Kahn | 381/92 |
| 5,506,908 | 4/1996 | Baumhauer et al. | 381/92 |
| 5,581,620 | 12/1996 | Brandstein et al. | 381/92 |
| 5,793,875 | 8/1998 | Lehr et al. | 381/92 |

FOREIGN PATENT DOCUMENTS 0374902A 6/1990 Germany .

WO9729614 8/1997 WIPO .

OTHER PUBLICATIONS

R. N. Marshall et al., "A New Microphone Providing Uniform Directivity Over an Extended Frequency Range," *J.A.S.A.*, vol. 12, Apr. 1941, pp. 481–497.

G. W. Elko et al., "A Simple Adaptive First–Order Differential Microphone," *IEEE ASSP Workshop*, Oct. 15–18, 1995, pp. 1–4.

H. F. Olson, "Polydirectional Microphone," *Proceedings of the I.R.E*, Feb., 1944, pp. 77–82.

K. Farrar, "Soundfield Microphone," *Wireless World*, Oct. 1979, pp. 48–50.

R. K. Furness, "Ambisonics—An Overview," *AES 8th International Conference*, pp. 181–189.

European Search Report dated Feb. 16, 1999 (3 pages).

*Primary Examiner*—Ping Lee

[57] ABSTRACT

A first-order differential microphone array with a fully steerable and variable response pattern. One illustrative embodiment of the present invention comprises a microphone array consisting of 6 small pressure-sensitive omnidirectional microphones flush-mounted on the surface of a ¾" diameter rigid nylon sphere. The microphones are advantageously located on the surface at points where included octahedron vertices contact the spherical surface. By selectively combining the three Cartesian orthogonal pairs with scalar weightings, a general first-order differential microphone beam (or a plurality of beams) is realized which can be directed to any angle (or angles) in three-dimensional space. The microphone array may find use in surround sound recording/playback applications and in virtual reality audio applications.

26 Claims, 11 Drawing Sheets b b c d b c d b c d

STEERABLE AND VARIABLE FIRST-ORDER DIFFERENTIAL MICROPHONE ARRAY

FIELD OF THE INVENTION

The subject matter of the present invention relates in general to the field of microphones and more particularly to an arrangement of a plurality of microphones (i.e., a microphone array) which provides a steerable and variable response pattern.

BACKGROUND OF THE INVENTION

Differential microphones with selectable beampatterns (i.e., response patterns) have been in existence now for more than 50 years. For example, one of the first such microphones was the Western Electric 639B unidirectional microphone. The 639B was introduced in the early 1940's and had a six-position switch to select a desired first-order pattern. Unidirectional differential microphones are commonly used in broadcast and public address applications since their inherent directivity is useful in reducing reverberation and noise pickup, as well as feedback in public address systems. Unidirectional microphones are also used extensively in stereo recording applications where two directional microphones are aimed in different directions (typically 90 degrees apart) for the left and right stereo signals.

Configurations of four-element cardioid microphone arrays arranged in a planar square arrangement and at the apices of a tetrahedron for general steering of differential beams have also been proposed and used in the past. (See, e.g., U. S. Pat. No. 3,824,342, issued on Jul. 16, 1974 to R. M. Christensen et al., and U. S. Pat. No. 4,042,779 issued on Aug. 16, 1977 to P. G. Craven et al.) However, none of these systems provide a fully steerable and variable beampattern at a reasonable cost. In particular, none of these prior art microphone arrays make use of (inexpensive) omnidirectional pressure-sensitive microphones in combination with a simple processor (e.g., a DSP), thereby enabling, at a modest cost, precise control of the beam-forming and steering of multiple first-order microphone beams.

SUMMARY OF THE INVENTION

The present invention provides a microphone array having a steerable response pattern, wherein the microphone array comprises a plurality of individual pressure-sensitive omnidirectional microphones and a processor adapted to compute difference signals between the pairs of the individual microphone output signals and to selectively combine these difference signals so as to produce a response pattern having an adjustable orientation of maximum reception. Specifically, the plurality of microphones are arranged in an N-dimensional spatial arrangement (N>1) which locates the microphones so that the distance therebetween is smaller than the minimum acoustic wavelength (as defined, for example, by the upper end of the operating audio frequency range of the microphone array). The difference signals computed by the processor advantageously effectuate first-order differential microphones, and a selectively weighted combination of these difference signals results in the microphone array having a steerable response pattern.

In accordance with one illustrative embodiment of the present invention, the microphone array consists of six small pressure-sensitive omnidirectional microphones flush-mounted on the surface of a ¾" diameter rigid nylon sphere. The six microphones are advantageously located on the surface at points where the vertices of an included regular octahedron would contact the spherical surface. By selectively combining the three Cartesian orthogonal pairs with appropriate scalar weightings, a general first-order differential microphone beam (or a plurality of beams) is realized which can be directed to any angle (or angles) in three-dimensional space. The microphone array of the present invention may, for example, find advantageous use in surround sound recording/playback applications and in virtual reality audio applications.

BRIEF DESCRIPTION OF THE DRAWINGS

FIG. 1A and 1B show directivity plots for a first-order differential microphone in accordance with Equation (1) having $\alpha$=0.55 and $\alpha$=0.20, respectively.

FIGS. 8A–8D show illustrative beampatterns of a synthesized cardioid steered to 30° for the frequencies 500 Hz, 2 kHz, 4 kHz, and 8 kHz, respectively.

FIGS. 11A–11D show illustrative beampatterns for a synthesized steered cardioid using the illustrative triangular microphone arrangement of FIG. 9 at selected frequencies of 500 Hz, 2 kHz, 4 kHz, and 8 kHz, respectively.

FIGS. 19A–19D show illustrative directivity patterns in the $\phi$-plane for an unbaffled synthesized cardioid microphone in accordance with an illustrative embodiment of the present invention, for 500 Hz, 2 kHz, 4 kHz, and 8 kHz, respectively.

FIGS. 20A–20D show illustrative directivity patterns of a synthesized cardioid using a 1.33 cm diameter rigid sphere baffle in accordance with an illustrative embodiment of the present invention, at 500 Hz, 2 kHz, 4 kHz, and 8 kHz, respectively.

DETAILED DESCRIPTION

I. Illustrative Two-dimensional Microphone Arrays

A. Overview

A first-order differential microphone has a general directional pattern E that can be written as $$E(\phi)=\alpha+(1-\alpha)\cos(\phi) \tag{1}$$

where $\phi$ is the azimuthal spherical angle and, typically, $0\leqq\alpha\leqq1$, so that the response is normalized to have a maximum value of 1 at $\phi=0°$. Note that the directivity is independent of the spherical elevation angle $\theta$. The magnitude of Equation (1) is the parametric expression for the "limacon of Pascal" algebraic curve, familiar to those skilled in the art. The two terms in Equation (1) can be seen to be the sum of an omnidirectional sensor (i.e., the first-term) and a first-order dipole sensor (i.e., the second term), which is the general form of the first-order array. Early unidirectional microphones such as, for example, the Western Electric 639A&B, were actually constructed by summing the outputs of an omnidirectional pressure sensor and a velocity ribbon sensor (which is essentially a pressure-differential sensor). (See, e.g., R. N. Marshall et al., "A new microphone providing uniform directivity over an extended frequency range," J. Acoust. Soc. Am., 12 (1941), pp. 481–497.)

Figure 1A:
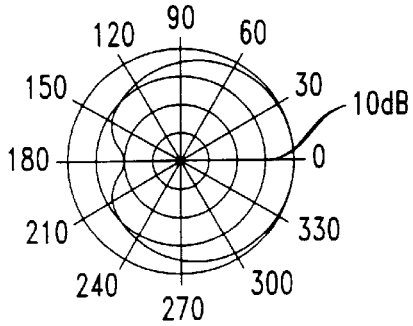
Figure 1A:
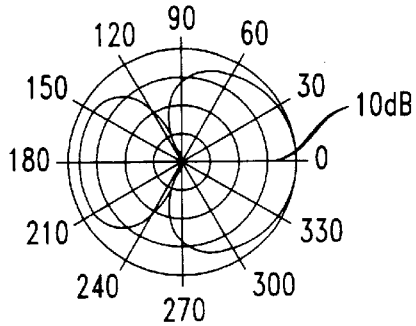

One implicit property of Equation (1) is that for $0\leqq\alpha\leqq1$, there is a maximum at $\theta=0$ and a minimum at an angle between $\pi/2$ and $\pi$. For values of $\alpha>0.5$, the response has a minimum at $\pi$, although there is no zero in the response. A microphone with this type of directivity is typically referred to as a "sub-cardioid" microphone. An illustrative example of the response for this case is shown in FIG. 1A, wherein $\alpha=0.55$. When $\alpha=0.5$, the parametric algebraic equation has a specific form which is referred to as a cardioid. The cardioid pattern has a zero response at $\phi=180°$. For values of $0\leqq\alpha\leqq0.5$ there is a null at $$\phi_{null}=\cos^{-1}\frac{\alpha}{\alpha-1}. \tag{2}$$

FIG. 1B shows an illustrative directional response corresponding to this case, wherein $\alpha=0.20$.

Thus, it can be seen that by appropriately combining the outputs of a dipole (i.e., a $\cos(\phi)$ directivity) microphone and an omnidirectional microphone, any general first-order pattern can advantageously be obtained. However, the main lobe response will always be located along the dipole axis. It would be desirable if it were possible to electronically "steer" the first-order microphone to any general direction in three-dimensional space. In accordance with the principles of the present invention, the solution to this problem hinges on the ability to form a dipole whose orientation can be set to any general direction, as will now be described herein.

Note first that a dipole microphone responds to the acoustic spatial pressure difference between two closely-spaced points in space. (By "closely-spaced" it is meant that the distance between spatial locations is much smaller that the acoustic wavelength of the incident sound.) In general, to obtain the spatial derivative along any direction, one can compute the dot product of the acoustic pressure gradient with the unit vector in the desired direction. For general dipole orientation in a plane, three or more closely-spaced non-collinear spatial pressure signals are advantageously employed. For general steering in three dimensions, four or more closely-spaced pressure signals are advantageously used. In the latter case, the vectors that are defined by the lines that connect the four spatial locations advantageously span the three-dimensional space (i.e., the four locations are not all coplanar), so that the spatial acoustic pressure gradient in all dimensions can be measured or estimated.

B. An Illustrative Two-dimensional Four Microphone Solution

For the two-dimensional case, an illustrative mechanism for forming a steerable dipole microphone signal (in a plane) can be determined based on the following trigonometric identity:

$$\cos(\phi-\psi)=\cos(\phi)\cos(\psi)+\sin(\phi)\sin(\psi) \tag{3}$$

In particular, from Equation (3) it can be seen that a steerable dipole (in a plane) can be realized by including the output of a second dipole microphone that has a directivity of $\sin(\phi)$. (Note that Equation (3) can be regarded as a restatement of the dot product rule, familiar to those of ordinary skill in the art.) These two dipole signals—$\cos(\phi)$ and $\sin(\phi)$—can be combined with a simple weighting thereof to obtain a steerable dipole. One way to create the $\sin(\phi)$ dipole signal is to introduce a second dipole microphone that is rotated at 90° relative to the first—i.e., the $\cos(\phi)$—dipole. In accordance with an illustrative embodiment of the present invention, the sensor arrangement illustratively shown in FIG. 2 advantageously provides such a result.

Figure 2:
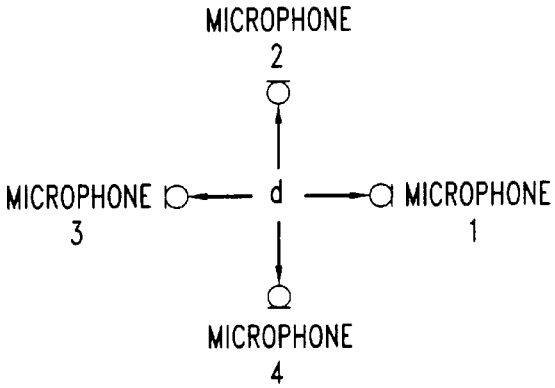
FIG. 2 shows a schematic of a two-dimensional steerable microphone arrangement in accordance with an illustrative embodiment of the present invention.

Note that the two orthogonal dipoles shown in FIG. 2 have phase-centers that are at the same position. The phase-center for each dipole is defined as the midpoint between each microphone pair that defines the finite-difference derived dipoles. It is a desirable feature in the geometric topology shown in FIG. 2 that the phase-centers of the two orthogonal pairs are, in fact, at the same location. In this manner, the combination of the two orthogonal dipole pairs is simplified by the in-phase combination of these two signals due to the mutual location of the phase center of the two dipole pairs.

In the illustrative system shown in FIG. 2, the two orthogonal dipoles are created by subtracting the two pairs of microphones that are across from one another (illustratively, microphone 1 from microphone 3, and, microphone 2 from microphone 4). For ease of notation let the microphone axis defined by microphones 1 and 3 be denoted as the "x-pair" (aligned along the Cartesian x-axis). Similarly the pair of microphones 2 and 4 is denoted as the "y-pair" (aligned along the Cartesian y-axis). To investigate the approximation of the subtracted omnidirectional microphones to form a dipole, the response may be calculated for an incident plane-wave field.

Specifically, for an incident plane-wave sound field with acoustic wavevector k, the acoustic pressure can be written as $$p(k,r,t)=P_o\exp^{j(\omega t-k\cdot r)} \tag{4}$$

where r is the position vector relative to the defined coordinate system origin, $P_o$ is the plane-wave amplitude, ω is the angular frequency, and $|k|=\omega/c$, where c is the speed of sound. If a dipole is formed by subtracting two omnidirectional sensors spaced by a distance d=2a, then the output $\Delta p(ka,\phi)$ is $$\Delta p(ka,\phi)=p(k,r_1,t)-p(k,r_2,t)=-2jP_o\sin(ka\cos(\phi)) \tag{5}$$

Note that for compactness, the time harmonic dependence has been omitted and the complex exponential term $\exp^{-jkr\cos(\phi)}$ has been conveniently removed by choosing the coordinate origin at the center of the microphones shown in FIG. 2. For frequencies where $kd<<\pi$, we can use the well known small angle approximation, $\sin(\theta)\approx\theta$, resulting in a microphone that has the standard dipole directivity $\cos(\phi)$. Note that implicit in the formation of dipole microphone outputs is the assumption that the microphone spacing d is much smaller than the acoustic wavelength over the frequency of operation. By combining the two dipole outputs that are formed as described above with the scalar weighting as defined in Equation (2), a steerable dipole output can be advantageously obtained. Specifically, the weightings $w_i$ for microphones $m_i$ which are appropriate for steering the dipole by an angle of ψ relative to the $m_1$–$m_2$ (i.e., the x-pair) axis, are $$w=\begin{bmatrix}\cos(\psi)\\ \sin(\psi)\\ -\cos(\psi)\\ -\sin(\psi)\end{bmatrix} \tag{6}$$

and the microphone signal vector m is defined as $$m=\begin{bmatrix}m_1(t)\\ m_2(t)\\ m_3(t)\\ m_4(t)\end{bmatrix} \tag{7}$$

The steered dipole is computed by the dot product $$E_d(\psi,t)=w\cdot m \tag{8}$$

where m and w are column vectors containing the omnidirectional microphone signals and the weightings, respectively, and where ω is the rotation angle relative to the x-pair microphone axis.

Figure 3:
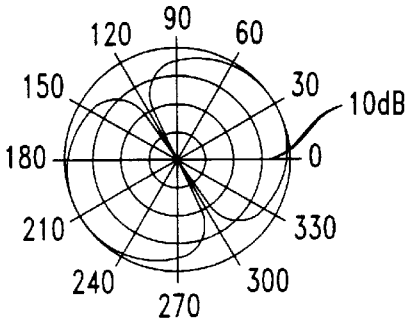
FIG. 3 shows an illustrative synthesized dipole output for a rotation of 30°, wherein the element spacing is 2.0 cm and the frequency is 1 kHz.
Figure 4:
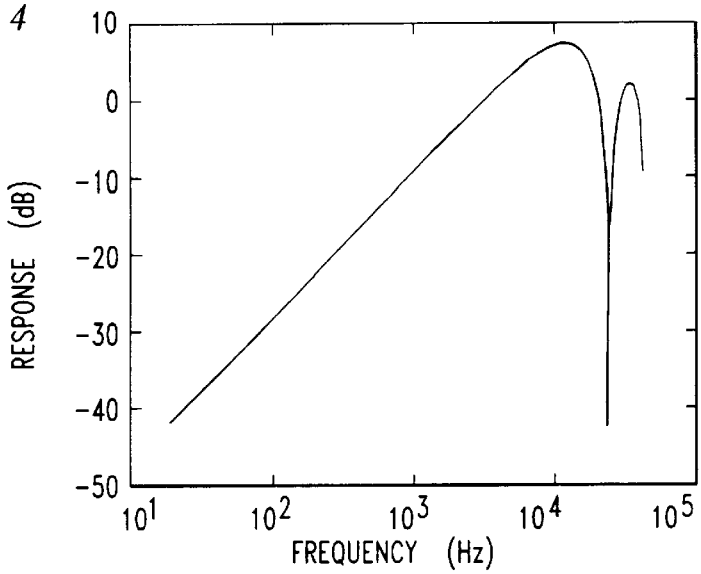
FIG. 4 shows a frequency response for an illustrative 30° steered dipole for signals arriving along the steered dipole axis (i.e., 30°).

FIG. 3 shows an illustrative computed output of a 30° synthesized dipole microphone rotated by 30°, derived from four omnidirectional microphones arranged as illustratively shown in FIG. 2. The element spacing d is 2.0 cm and the frequency is 1 kHz. FIG. 4 shows an illustrative frequency response in the direction along the dipole axis for a 30° -steered dipole. In particular, note from FIG. 4 that, first, the dipole response is directly proportional to the frequency (ω), and, second, the first zero occurs at a frequency in excess of 20 kHz (for a microphone spacing of 2 cm). It is interesting to note that for a plane wave incident along one of the dipole axes, the first zero in the frequency response occurs when $kd=2\pi$. The frequency at which the first zero occurs for on-axis incidence for a dipole formed by omnidirectional elements spaced 2 cm apart is 17,150 Hz (assuming that the speed of sound is 343 m/s). The reason for the higher null frequency in FIG. 4 is that the incident sound field is not along a dipole axis, and therefore the distance traveled by the wave between the sensors is less than the sensor spacing d.

In accordance with an illustrative embodiment of the present invention, a general first-order pattern may be formed by combining the output of the steered dipole with that of an omnidirectional output. Note, however, that the following two issues should advantageously be considered. First, as can be seen from Equation (5), the dipole output has a first-order high-pass frequency response. It would therefore be desirable to either high-pass filter the flat frequency response of the omnidirectional microphone, or to place a first-order lowpass filter on the dipole output to flatten the response. One potential problem with this approach, however, is due to the concomitant phase difference between the omnidirectional microphone and the filtered dipole, or, equivalently, the phase difference between the filtered omnidirectional microphone and the dipole microphone. Second, note that there is a factor of j in Equation (5). To compensate for the π/2 phase shift, either the output of the omnidirectional microphone or of the dipole would apparently need to be advantageously filtered by, for example, a Hilbert all-pass filter (familiar to those skilled in the art), which filter is well known to be acausal and of infinite length. With the difficulties listed above, it would at first appear problematic to realize the general steerable first-order differential microphone in accordance with the above-discussed approach.

However, in accordance with an illustrative embodiment of the present invention, there is an elegant way out of this apparent dilemma. By first forming forward and backward facing cardioid signals for each microphone pair and summing these two outputs, an omnidirectional output that is in-phase having an identical high-pass frequency response to the dipole can be advantageously obtained. To investigate the use of such back-to-back cardioid signals to form a general steerable first-order microphone, it is instructive to first examine how a general non-steerable first order microphone can be realized with only 2 omnidirectional microphones. In particular, a simple modification of the differential combination of the omnidirectional microphones advantageously results in the formation of two outputs that have back-to-back cardioid beampatterns. Specifically, a delay is provided before the subtraction, where the delay is equal to the propagation time for sounds impinging along the microphone pair axis. The topology of this arrangement is illustratively shown in FIG. 5 for one pair of microphones.

The forward cardioid microphone signals for the x-pair and y-pair microphones can be written as $$C_{Fx}(ka,\phi)=-2jP_o\sin(ka[1+\cos\phi]) \tag{9}$$

and $$C_{Fy}(ka,\phi)=-2jP_o\sin(ka[1+\sin\phi]) \tag{10}$$

The back-facing cardioids can similarly be written as $$C_{Bx}(ka,\phi)=-2jP_o\sin(ka[1-\cos\phi]) \tag{11}$$

and $$C_{By}(ka,\phi)=-2jP_o\sin(ka[1-\sin\phi]) \tag{12}$$

Note from Equations (9)–(12) that the output levels from the forward and back-facing cardioids are twice that of the derived dipole (i.e., Equation (5)) for signals arriving at $\phi=0°$ and $\phi=180°$, respectively, for the x-pair. (Similar results apply to the y-pair for signals arriving from $\phi=90°$ and $\phi=270°$.)

Figure 6:
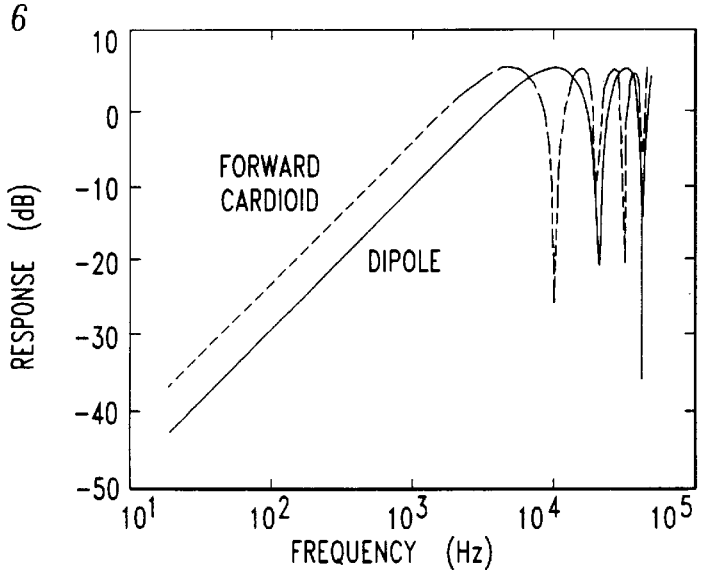
FIG. 6 shows a frequency response for an illustrative 0° steered dipole and an illustrative forward cardioid for signals arriving along the $m_1$–$m_3$ axis of the illustrative microphone arrangement shown in FIG. 2.

FIG. 6 shows an illustrative frequency response for signals arriving along the x-dipole axis as well as an illustrative response for the forward facing derived cardioid. As can be seen from the figure, the SNR (Signal-to-Noise Ratio) from the illustrative cardioid is 6 dB higher than the derived dipole signal. However, the upper cutoff frequency for the cardioids are one-half of the dipole cutoff frequency as can also be seen from FIG. 6 (ka $=\pi$). One attractive solution to this upper cutoff frequency "problem" is to reduce the microphone spacing by a factor of 2. By reducing the microphone spacing to ½ of the original spacing, the cardioids will have the same SNR and bandwidth as the original dipole with spacing d. Another advantage to reducing the microphone spacing is the reduced diffraction and scattering of the physical microphone structure. (The effects of scattering and diffraction will be discussed further below.) The reduction in microphone spacing does, however, have the effect of increasing the sensitivity of microphone channel phase difference error.

If both the forward and back-facing cardioids are added, the resulting outputs are $$\begin{aligned}E_{cx\text{-}omni}(ka,\phi) &= 1/2[C_{Fx}(ka,\phi)+C_{Bx}(ka,\phi)] \\ &= -2jP_o\sin(ka)\cos(ka\cos\phi)\end{aligned} \tag{13}$$

and $$\begin{aligned}E_{cy\text{-}omni}(ka,\phi) &= 1/2[C_{Fy}(ka,\phi)+C_{By}(ka,\phi)] \\ &= -2jP_o\sin(ka)\cos(ka\sin\phi)\end{aligned} \tag{14}$$

For small values of the quantity ka, Equations (13) and (14) have frequency responses that are first-order highpass, and the directional patterns are that of omnidirectional microphones. The $\pi/2$ phase shift aligns the phase of the cardioid-derived omnidirectional response to that of the dipole response (Equation (5)). Since it is only necessary to have one omnidirectional microphone signal, the average of both omnidirectional signals can be advantageously used, as follows:

$$E_{omni}(ka,\phi)=\tfrac{1}{2}[E_{x\text{-}omni}(ka,\phi)+E_{y\text{-}omni}(ka,\phi)] \tag{15}$$

By using the average omnidirectional output signal, the resulting directional response will be advantageously closer to a true omnidirectional pattern at high frequencies. The subtraction of the forward and back-facing cardioids yield dipole responses, as follows:

$$\begin{aligned}E_{cx\text{-}dipole}(ka,\phi) &= C_{Fx}(ka,\phi)-C_{Bx}(ka,\phi) \\ &= -2jP_o\cos(ka)\sin(ka\cos\phi)\end{aligned} \tag{16}$$

and $$\begin{aligned}E_{cy\text{-}dipole}(ka,\phi) &= C_{Fy}(ka,\phi)-C_{By}(ka,\phi) \\ &= -2jP_o\cos(ka)\sin(ka\sin\phi)\end{aligned} \tag{17}$$

The finite-difference dipole responses (from Equation (5)) are $$E_{x\text{-}dipole}(ka,\phi)=-2jP_o\sin(ka\cos\phi) \tag{18}$$

and $$E_{y\text{-}dipole}(ka,\phi)=-2jP_o\sin(ka\sin\phi) \tag{19}$$

Thus by forming the sum and the difference of the two orthogonal pairs of the back-to-back cardioid signals it is possible to form any first-order microphone response pattern oriented in a plane. Note from Equations (13)–(19) that the cardioid-derived dipole first zero occurs at one-half the value of the cardioid-derived omnidirectional term (i.e., ka$=\pi/2$), for signals arriving along the axis of one of the two pairs of microphones.

Figure 7:
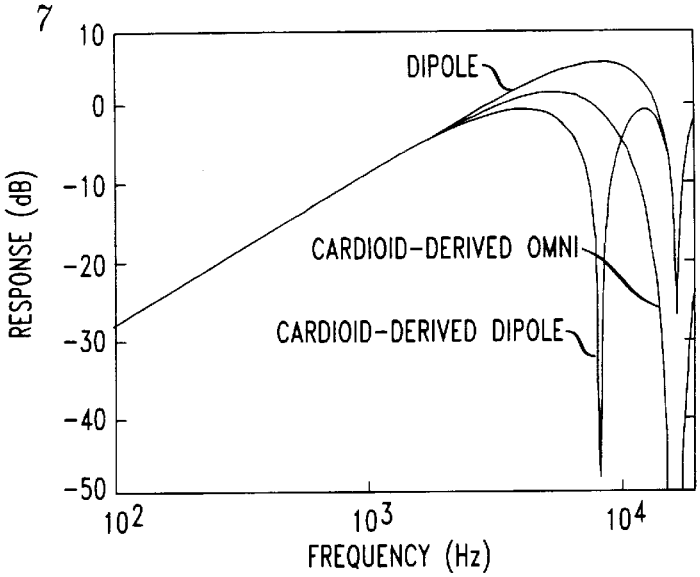
FIG. 7 shows frequency responses for an illustrative difference-derived dipole, an illustrative cardioid-derived dipole, and an illustrative cardioid-derived omnidirectional microphone, wherein the microphone element spacing is 2 cm.
Figure 8A:
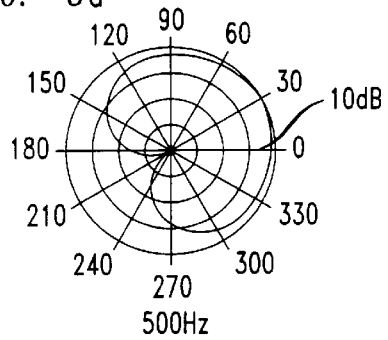
Figure 8A:
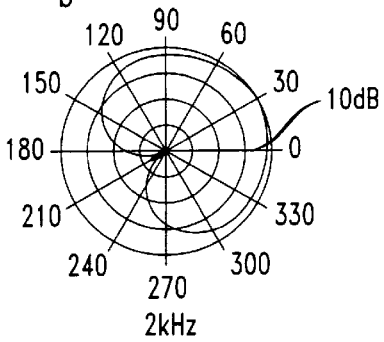
Figure 8A:
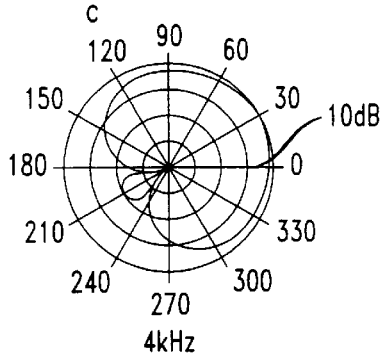
Figure 8A:
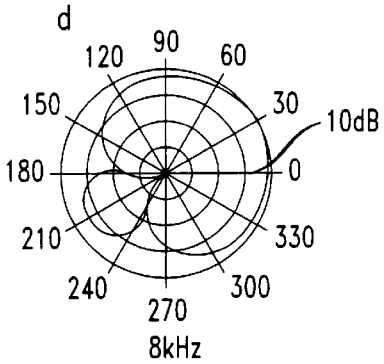

FIG. 7 shows illustrative frequency responses for signals incident along a microphone pair axis. (At this angle the zero occurs in the cardioid-derived dipole term at the frequency where ka$=\pi/2$.) Specifically, it shows frequency responses for an illustrative difference-derived dipole, an illustrative cardioid-derived dipole, and an illustrative cardioid-derived omnidirectional microphone, wherein the microphone element spacing is 2 cm. The fact that the cardioid-derived dipole has the first zero at one-half the frequency of the finite-difference dipole and cardioid-derived omnidirectional microphone, narrows the effective bandwidth of the design for a fixed microphone spacing. From an SNR perspective, using the cardioid-derived dipole and the finite-difference dipole are equivalent. This might not be immediately apparent, especially in light of the results shown in FIG. 7. However, the cardioid-derived dipole actually has an output signal that is 6 dB higher than the finite-difference dipole at low frequencies at any angle other than the directional null. Thus, one can halve the spacing of the cardioid-derived dipole and advantageously obtain the exact same signal level as the finite difference dipole at the original spacing. Therefore the two ways of deriving the dipole term can be made to be equivalent. The above argument, however, neglects the effects of actual sensor mismatch. The cardioid-derived dipole with one-half spacing is actually more sensitive to the mismatch problem, and, as a result, might be more difficult to implement.

Another potential problem with an implementation that uses cardioid-derived dipole signals is the bias towards the cardioid-derived omnidirectional microphone at high frequencies (see FIG. 7). Therefore, as the frequency increases, there will be a tendency for the first-order microphone to approach a directivity that is omnidirectional, unless the user chooses a pattern that is essentially a dipole pattern (i.e., $\alpha\approx 0$ in Equation (1)). By choosing the combination of the cardioid-derived omnidirectional microphone and the finite-difference dipole, the derived first-order microphone will tend to a dipole pattern at high frequencies. The bias towards omnidirectional and dipole behavior can be advantageously removed by appropriately filtering one or both of the dipole and omnidirectional signals. Since the directivity bias is independent of microphone orientation, a simple fixed low-pass or highpass filter can make both frequency responses equal in the high frequency range.

Figure 5:
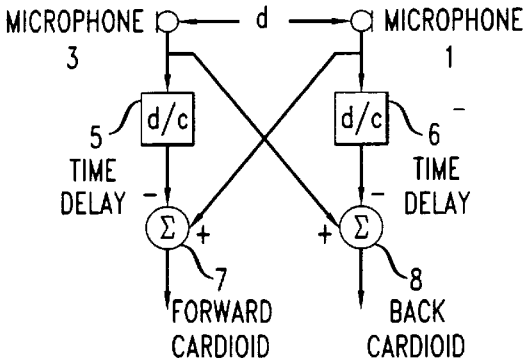
FIG. 5 shows a diagram of a combination of two omnidirectional microphones to obtain back-to-back cardioid microphones in accordance with an illustrative embodiment of the present invention.

Another consideration for a real-time implementation of a steerable microphone in accordance with certain illustrative embodiments of the present invention is that of the time/phase-offset between the dipole and derived omnidirectional microphones. With reference to FIG. 5, the dipole signal in a time sampled system will necessarily be obtained either before or after the sampling delays used in the formation of the cardioids. Thus, there will be a time delay offset of one-half the sampling rate between these two signals. This delay can be compensated for either by using an all-pass constant delay filter, or by summing the two dipole signals on either side of the delays shown in FIG. 5. The summation of the two dipole signals forces the phase alignment of the derived dipole and omnidirectional microphones. But, note that the dipole summation is identical to the cardioid-derived dipole described above. (This issue will be discussed further below in conjunction with the discussion of a real-time implementation of an illustrative embodiment of the present invention.) The dipole pattern has directional gain, and by definition, the omnidirectional microphone has no gain. Therefore, the approach that uses the cardioid-derived omnidirectional microphone and the finite-difference dipole is to be preferred.

FIG. 8 shows calculated results for the beampatterns at a few select frequencies for an illustrative synthesized cardioid steered 30° relative to the x-axis. The calculations were performed using the finite-difference dipole signals and the cardioid-derived omnidirectional signals. The steered cardioid output $Y_c(ka,30°)$, based on Equations (1), (17), and (15), is $$Y_c(ka, 30°) = \frac{1}{2}\Big[\cos(30°)E_{cx\text{-}dipole}(ka, 30°) + \sin(30°)E_{cy\text{-}dipole}(ka, 30°) + E_{omni}(ka, 30°)\Big] \tag{20}$$

FIGS. 8A–8D show beampatterns of an illustrative synthesized cardioid steered to 30° for the frequencies 500 Hz, 2 kHz, 4 kHz, and 8 kHz, respectively. It can clearly be seen from this figure that the beampattern moves closer to the dipole directivity as the frequency is increased. This behavior is consistent with the results shown in FIG. 7 and discussed above.

C. An Illustrative Two-dimensional Three Microphone Solution

It was shown above that a two-dimensional steerable dipole can be realized in accordance with an illustrative embodiment of the present invention by using four omnidirectional elements located in a plane. However, in accordance with another illustrative embodiment of the present invention, similar results can also be realized with only three microphones. To form a dipole oriented along any line in a plane, all that is needed is to have enough elements positioned so that the vectors defined by the lines connecting all pairs span the space. Any three non-collinear points completely span the space of the plane. Since it is desired to position the microphones to "best" span the space, two "natural" illustrative arrangements are considered herein—the equilateral triangle and the right isosceles triangle. For the right isosceles triangle case, the two vectors defined by the connection of the point at the right angle and to the points at the opposing vertices represent an orthogonal basis for a plane. Vectors defined by any two sides of the equilateral triangle are not orthogonal, but they can be easily decomposed into two orthogonal components.

Figure 9:
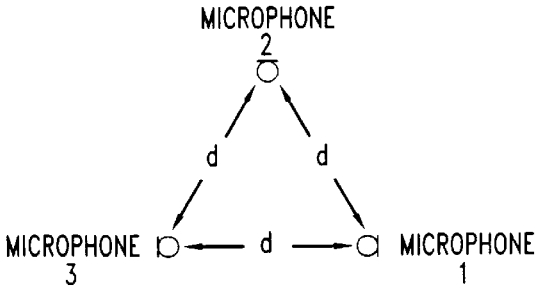
FIG. 9 shows a schematic of a three-element arrangement of microphones to realize a two-dimensional steerable dipole in accordance with an illustrative embodiment of the present invention.

FIG. 9 shows a schematic of a three-element arrangement of microphones to realize a two-dimensional steerable dipole in accordance with an illustrative embodiment of the present invention. This illustrative equilateral triangle arrangement has two implementation advantages, as compared with the alternative right isosceles triangle arrangement. First, since all three vectors defined by the sides of the equilateral triangle have the same length, the finite-difference derived dipoles all have the same upper cutoff frequency. Second, the three derived dipole outputs have different "phase-centers." (As before, the "phase-center" is defined as the point between the two microphones that is used to form the finite-difference dipole.) The distance between the individual dipole phase centers for the equilateral triangle arrangement is smaller (by $\int 2$) than for the right triangle arrangement (i.e., for the sides that for the right angle are equal to the equilateral side length). The offset of the phase-centers results in a small phase shift that is a function of the incident angle of the incident sound. The phase-shift due to this offset results in interference cancellation at high frequencies. However, the finite-difference approximation also becomes worse at high frequencies as was shown above. The offset spacing is one-half the spacing between the elements that are used to form the derived dipole and omnidirectional signals. Therefore, the effects of the offset of the "phase-centers" are smaller than the finite-difference approximation for the spatial derivative, and, thus, they can be neglected in practice.

A generally-oriented dipole can advantageously be obtained by appropriately combining two or three dipole signals formed by subtracting all unique combinations of the omnidirectional microphone outputs. Defining these three finite-difference derived dipole signals as $d_1(t)$, $d_2(t)$, and $d_3(t)$, and defining the unit vectors aligned with these three dipole signals as $e_1$, $e_2$, and $e_3$, respectively, then a signal $d_0(t)$ for a dipole oriented along a general direction defined by unit vector $\hat{v}$ is $$d_0(t) = \frac{D_3 \cdot J_3}{\|J_3\|} \tag{21}$$

where $$D_3' = [d_1(t)d_2(t)d_3(t)] \tag{22}$$

and $$J_3' = [e_1\hat{v}e_2 \cdot \hat{v}e_3\hat{v}] \tag{23}$$

Note that Equation (21) is valid for any general arrangement of three closely-spaced microphones. However, as pointed out above, a preferable choice is an arrangement that places the microphones at the vertices of an equilateral triangle, as in the illustrative embodiment shown in FIG. 9.

Figure 10:
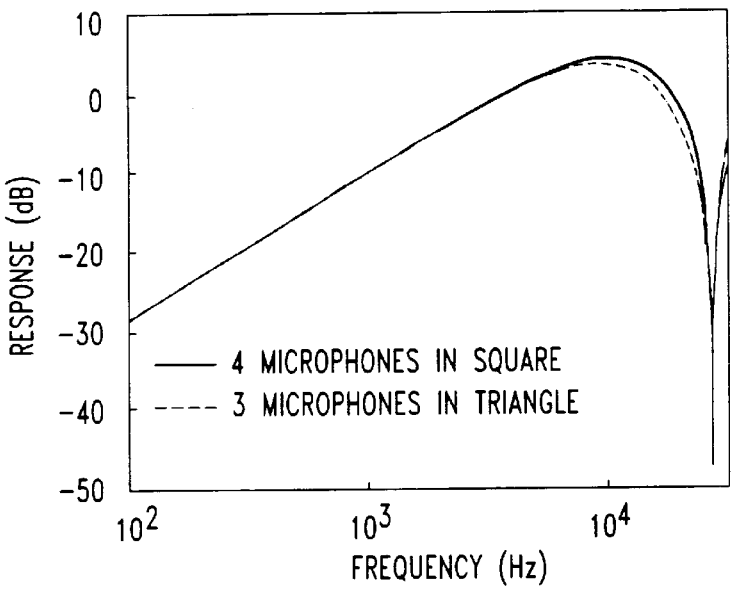
FIG. 10 shows illustrative frequency responses for signals arriving along the x-axis for the illustrative triangular and square arrangements shown in FIGS. 9 and 2, respectively.
Figure 11A:
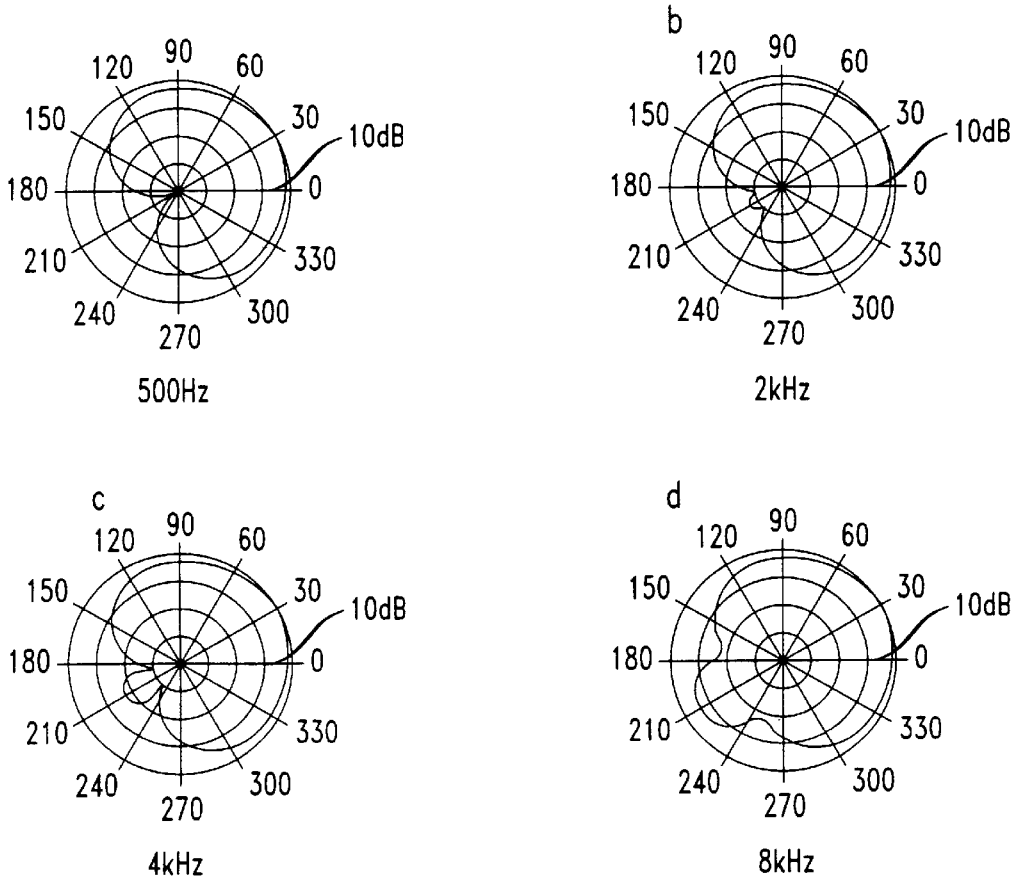

FIG. 10 shows the frequency response of a synthesized cardioid that is oriented along the x-axis for both the illustrative 4-microphone square arrangement and the illustrative 3-microphone equilateral triangle arrangement. As can be seen in the figure, the differences between these two curves is very small and only becomes noticeable at high frequencies that are out of the desired operating range of the 2.0 cm spaced microphone.

FIGS. 11A–11D show illustrative calculated beampattern results at selected frequencies (500 Hz, 2 kHz, 4 kHz, and 8 kHz) for three 2.0 cm spaced microphones arranged at the vertices of an equilateral triangle as in the illustrative embodiment of FIG. 9. Again, the beampatterns may be computed by appropriately combining the synthesized steered dipole and the omnidirectional output with appropriate weightings. The effect of the phase center offset for the three-microphone implementation becomes evident at 2 kHz. As can be seen from the figures, the effect becomes even larger at higher frequencies. Comparison of the illustrative beampatterns shown in FIGS. 11A–11D with those shown in FIGS. 8A–8D show that the differences at the higher frequencies between the illustrative four-microphone and three-microphone realizations are small and most probably insignificant from a perceptual point of view.

II. The Directivity Index

As is well known to those skilled in the art, one very useful measure of the directional properties of directional transducers (i.e., microphones and loudspeakers) is known as the "directivity index." The directivity index value is proportional to the gain of a directional transducer relative to that of an omnidirectional transducer in a spherically isotropic sound field. Mathematically the directivity index (in dB) is defined as $$DI(\omega, \theta_0, \phi_0) = 10\log\left[\frac{4\pi|E(\omega, \theta_0, \phi_0)|^2}{\int_0^{2\pi}\int_0^{\pi}|E(\omega, \theta, \phi)|^2 \sin\theta\, d\theta d\phi}\right] \tag{24}$$

where the angles $\theta$ and $\phi$ are the standard spherical coordinate angles, $\theta_0$ and $\phi_0$ are the angles at which the directivity factor is being measured, and $E(\omega,\theta,\phi)$ is the pressure response to a planewave of angular frequency $\omega$ propagating at spherical angles $\theta$ and $\phi$. For sensors that are axisymmetric (i.e., independent of $\theta$), $$DI(\omega, \phi_0) = 10\log\left[\frac{2|E(\omega, \phi_0)|^2}{\int_0^{\pi}|E(\omega, \phi)|^2 d\phi}\right] \tag{25}$$

Figure 12:
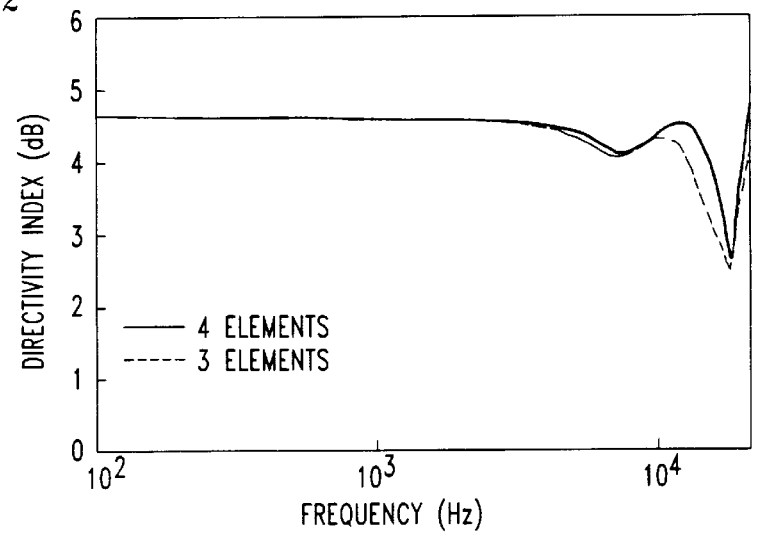
FIG. 12 shows illustrative directivity indices of a synthesized cardioid for the illustrative 4-element and 3-element microphone element arrangements of FIGS. 2 and 9, respectively, with 2 cm element spacing.

FIG. 12 shows the directivity indices of an illustrative synthesized cardioid directed along one of the microphone pair axes for the combination of a cardioid-derived omnidirectional and finite-difference dipole for the illustrative square 4-element and the illustrative equilateral triangle 3-element microphone arrangements as a function of frequency. The differences between the 3-element and 4-element arrangements are fairly small and limited to the high frequency region where the phase-center effects start to become noticeable. The minimum in both directivity indices occurs at the frequency of the first zero in the response of the finite-difference dipole (i.e., at $kd=2\pi$, or when f=17,150 Hz for 2 cm element spacing). If the synthesized cardioid beampattern is close to an ideal cardioid beampattern—i.e., $\frac{1}{2}[1+\cos(\phi)]$—the directivity index would be approximately 4.8 dB over the design bandwidth of the microphone. The combination of cardioid-derived omni and difference-derived dipole results in a directivity index that is less variable over a wider frequency range. The main advantage of the implementation derived from the cardioid-derived omnidirectional and difference-derived dipole is that the spacing can be advantageously larger. This larger spacing results in a reduced sensitivity to microphone element phase differences.

Figure 13:
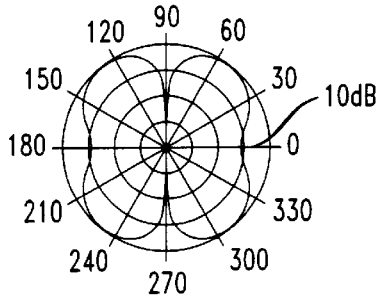
FIG. 13 shows an illustrative directivity pattern for a 2 cm spaced difference-derived dipole at 15 kHz.

The directivity index for an ideal dipole (i.e., $\cos(\phi)$ directivity) is 4.77 dB. From looking at FIG. 12, it is not clear why the directivity index of the combination of the cardioid-derived omni and the derived dipole term ever fall below 4.8 dB at frequencies above 10 kHz. By examining FIG. 7 it appears that the dipole term dominates at the high frequencies and that the synthesized cardioid microphone should therefore default to a dipole microphone. The reason for this apparent contradiction is that the derived dipole microphone (produced by the subtraction of two closely-spaced omnidirectional microphones) deviates from the ideal $\cos(\phi)$ pattern at high frequencies. The maximum of the derived dipole is no longer along the microphone axis. FIG. 13 shows an illustrative directivity pattern of the difference-derived dipole at 15 kHz.

III. Illustrative Three-dimensional Microphone Arrays

A. An Illustrative Six Microphone Array

In accordance with additional illustrative embodiments of the present invention, the third dimension may be added in a manner consistent with the above-described two-dimensional embodiments. In particular, and in accordance with one particular illustrative embodiment of the present invention, two omnidirectional microphones are added to the illustrative two-dimensional array shown in FIG. 2—one microphone is added above the plane shown in the figure and one microphone is added below the plane shown in the figure. This pair will be referred to as the z-pair. As before, these two microphones are used to form forward and back-facing cardioids. The response of these cardioids is $$C_{Fz}(ka,\theta) = -2jP_o \sin(ka[1+\cos\theta]) \tag{26}$$

and $$C_{Bz}(ka,\theta) = -2jP_o \sin(ka[1-\cos\theta]) \tag{27}$$

where $\theta$ is the spherical elevation angle. The omnidirectional and finite-difference dipole responses are $$\begin{aligned} E_{z\text{-}omni}(ka, \theta) &= 1/2[C_{Fz}(ka, \theta) + C_{Bz}(ka, \theta)] \\ &= -2jP_o \sin(ka)\cos(ka\cos\theta) \end{aligned} \tag{28}$$

and $$E_{z\text{-}dipole}(ka, \theta) = -2jP_o \sin(ka\cos\theta) \tag{29}$$

As before, it is only necessary to have one omnidirectional term to form the steerable first-order microphone. The average omnidirectional microphone signal from the 3-axes omnidirectional microphones is, therefore, $$E_{omni}(ka, \phi, \theta) = \frac{1}{3}\left[E_{x\text{-}omni}(ka, \phi) + E_{y\text{-}omni}(ka, \phi) + E_{z\text{-}omni}(ka, \theta)\right] \tag{30}$$

The weighting for the x, y, z dipole signals to form a dipole steered to $\psi$ in the azimuthal angle and $\chi$ in the elevation angle are $$w = \begin{bmatrix} \cos(\psi)\sin(x) \\ \sin(\psi)\sin(x) \\ \cos(x) \end{bmatrix} \tag{31}$$

The steered dipole signal can therefore be written as $$E_d(\psi, \chi) = w \cdot D \tag{32}$$

where

-continued $$D = \begin{bmatrix} E_{x\text{-}dipole} \\ E_{y\text{-}dipole} \\ E_{z\text{-}dipole} \end{bmatrix} \tag{33}$$

Again, the synthesized first-order differential microphone is obtained by combining the steered-dipole and the omnidirectional microphone with the appropriate weightings for the desired first-order differential beampattern.

Figure 14:
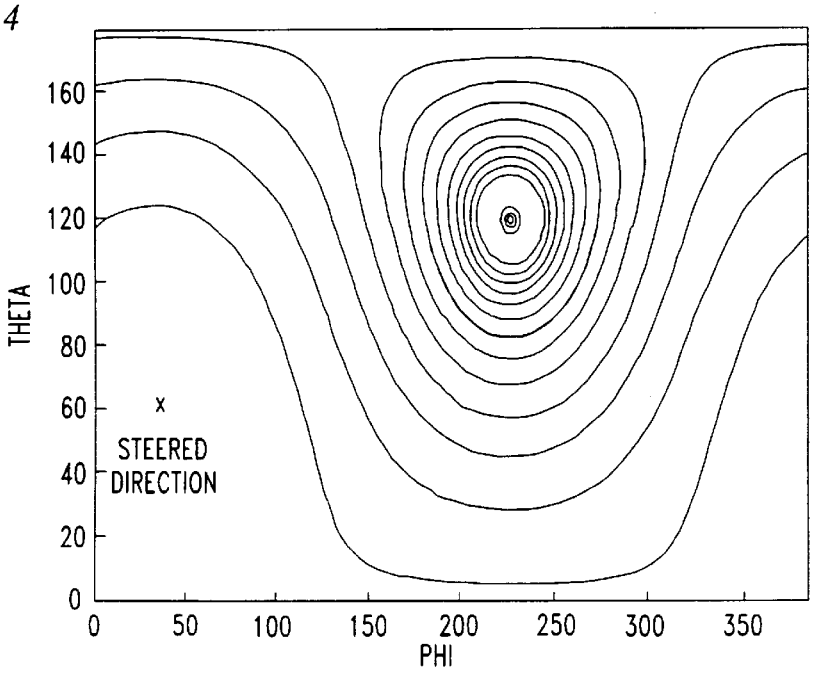
FIG. 14 shows a contour plot (at 3 dB intervals) of an illustrative synthesized cardioid in accordance with the principles of the present invention, steered to $\psi$=30° and $\chi$=60°, as a function of $\phi$ and $\theta$.

FIG. 14 shows an illustrative contour plot of a synthesized cardioid microphone steered to $\psi=30°$ and $\chi=60°$. The microphone element spacing is 2 cm and the frequency is 1 kHz. The contours are in 3 dB steps. As is well known to those skilled in the art, the null for a cardioid steered to $\psi=30°$ and $\chi=60°$ should, in fact, occur at $\phi=180°+30°=210°$ and $\theta=180°-60°=120°$ which is where the null can be seen in FIG. 14.

B. An Illustrative Four Microphone Array

As for the case of steering in a plane, it is possible to realize three-dimensional steering with fewer than the six-element cubic microphone arrangement described above. In particular, three-dimensional steering can be realized as long as the three-dimensional space is spanned by all of the unique combinations of dipole axes formed by connecting the unique pairs of microphones. For a symmetric arrangement of microphones, no particular Cartesian axis is preferred (by larger element spacing) and the phase-centering problem is minimized. Thus, in accordance with another illustrative embodiment of the present invention, one good geometric arrangement is to place the elements at the vertices of a regular tetrahedron (i.e., a three-dimensional geometric figure in which all sides are equilateral triangles). Six unique finite-difference dipoles can be formed from the regular tetrahedron geometry. If the six dipole signals are referred to as, $d_i(t)$, where i=1–6, and the unit vectors aligned with the dipole axes are defined as, $e_i$, for i=1–6, then the dipole signal oriented in the direction of the unit vector, v, is $$d_0(t) = \frac{D_6 \cdot J_6}{\|J_6\|} \tag{34}$$

where $$D_6^t=[d_1(t)d_2(t)d_3(t)d_4(t)d_5(t)d_6(t)] \tag{35}$$

and $$J_6^t=[e_1\cdot\hat{v}e_2\cdot\hat{v}e_3\cdot\hat{v}e_4\cdot\hat{v}e_5\cdot\hat{v}e_6\cdot\hat{v}] \tag{36}$$

The unit vector $\hat{v}$ in terms of the desired steering angles $\psi$ and $\chi$ is $$\hat{v} = \begin{bmatrix} \cos(\psi)\sin(x) \\ \sin(\psi)\sin(x) \\ \cos(x) \end{bmatrix} \tag{37}$$

Note that Equation (36) is valid for any general arrangement of four closely-spaced microphones that span three-dimensional space. However, as pointed out above, in accordance with an illustrative embodiment of the present invention, one advantageous choice for the positions of the four microphone elements are at the vertices of a regular tetrahedron.

Figure 15:
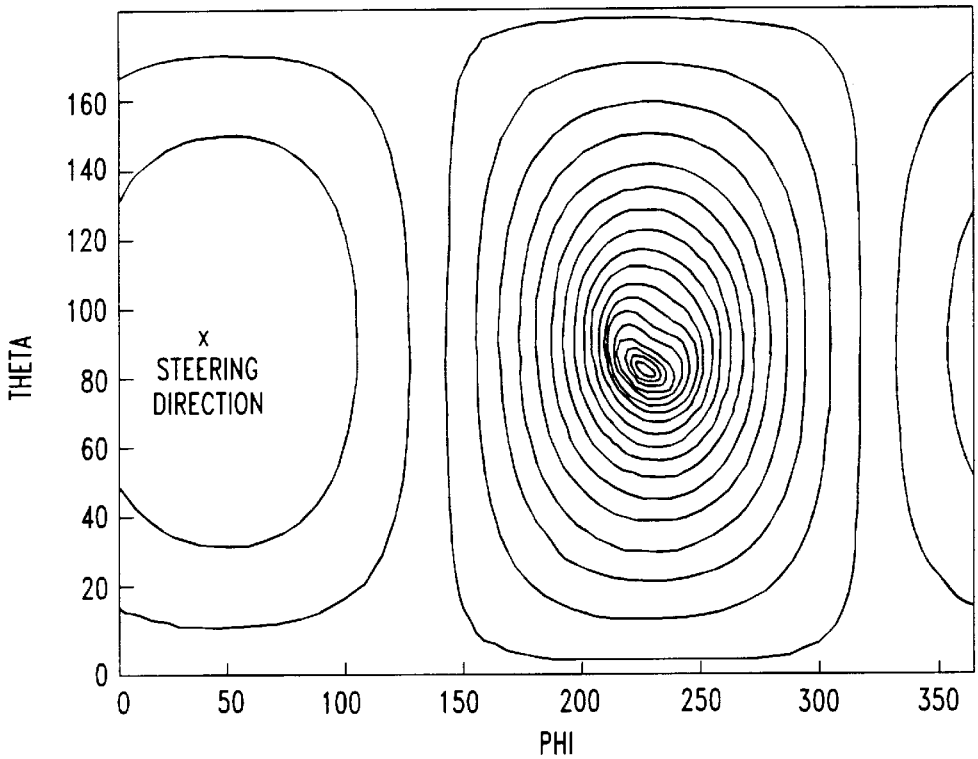
FIG. 15 shows a contour plot (at 3 dB intervals) of an illustrative tetrahedral synthesized cardioid in accordance with the principles of the present invention, steered to $\psi$=45° and $\chi$=90°, as a function of $\phi$ and $\theta$.

FIG. 15 shows an illustrative contour plot (at 3 dB intervals) of a 4-element tetrahedral synthesized cardioid microphone steered in accordance with the principles of the present invention to $\psi=45°$ and $\chi=90°$, as a function of $\phi$ and $\theta$. The microphone element spacing is 2 cm and the frequency is 1 kHz. The contours are in 3 dB steps. As is familiar to those skilled in the art, the null for a cardioid steered to $\psi=45°$ and $\chi=90°$ should occur at $\phi=180°+45°=225°$ and $180°-90°=90°$, which is where the null can be seen in FIG. 15.

IV. Illustrative Physical Microphone Realizations

In accordance with one illustrative embodiment of the present invention, a six element microphone array may be constructed using standard inexpensive pressure microphones as follows. For mechanical strength, the six microphones may be advantageously installed into the surface of a small (¾ "diameter) hard nylon sphere. Another advantage to using the hard sphere is that the effects of diffraction and scattering from a rigid sphere are well known and easily calculated. For planewave incidence, the solution for the acoustic field variables can be written down in exact form (i.e., an integral equation), and can be decomposed into a general series solution involving spherical Hankel functions and Legendre polynomials, familiar to those skilled in the art. In particular, the acoustic pressure on the surface of the rigid sphere for an incident monochromatic planewave can be written as $$p(ka,\theta) = \frac{jP_o}{(ka)^2}\sum_{n=0}^{\infty}\frac{j^n(2n+1)P_n(\cos\theta)}{h_n'(ka)}$$

where $P_o$ is the incident acoustic planewave amplitude, $P_n$ is the Legendre polynomial of degree n, $\theta$ is the rotation angle between the incident wave and the angular position on the sphere where the pressure is calculated, a is the sphere radius, and $h'_n$ is the first derivative with respect to the argument of the spherical Hankel function of the first kind with degree n. The series solution converges rapidly for small values of the quantity (ka). Fortunately, this is the regime which is precisely where the differential microphone is intended to be operated (by definition). For very small values of the quantity (ka)—i.e., where $ka<<\pi$—Equation (38) can be truncated to two terms, namely, $$p(ka,\theta) \approx P_o\left(1+\frac{3}{2}jka\cos\theta\right) \tag{39}$$

One interesting observation that can be made in examining Equation (39) is that the equivalent spacing between a pair of diametrically placed microphones for a planar sound wave incident along the microphone pair axis is 3a and not 2a. This difference is important in the construction of the forward and back-facing cardioid signals.

Figure 16:
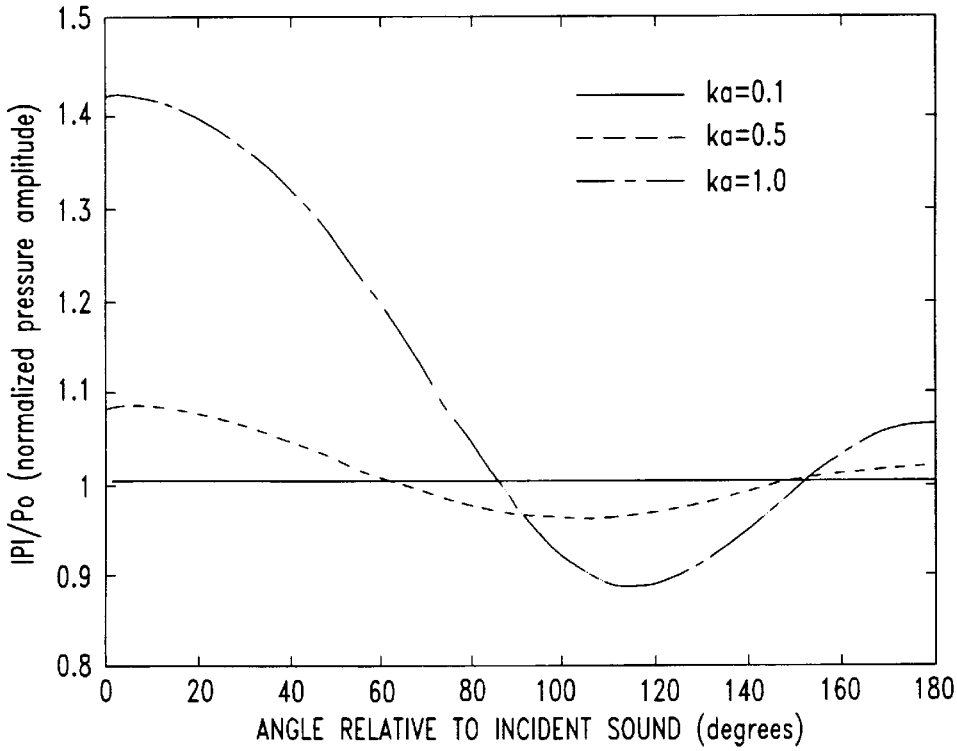
FIG. 16 shows the normalized acoustic pressure on the surface of a rigid sphere for plane wave incidence at $\theta=0°$ for ka=0.1, 0.5, and 1.0.
Figure 17:
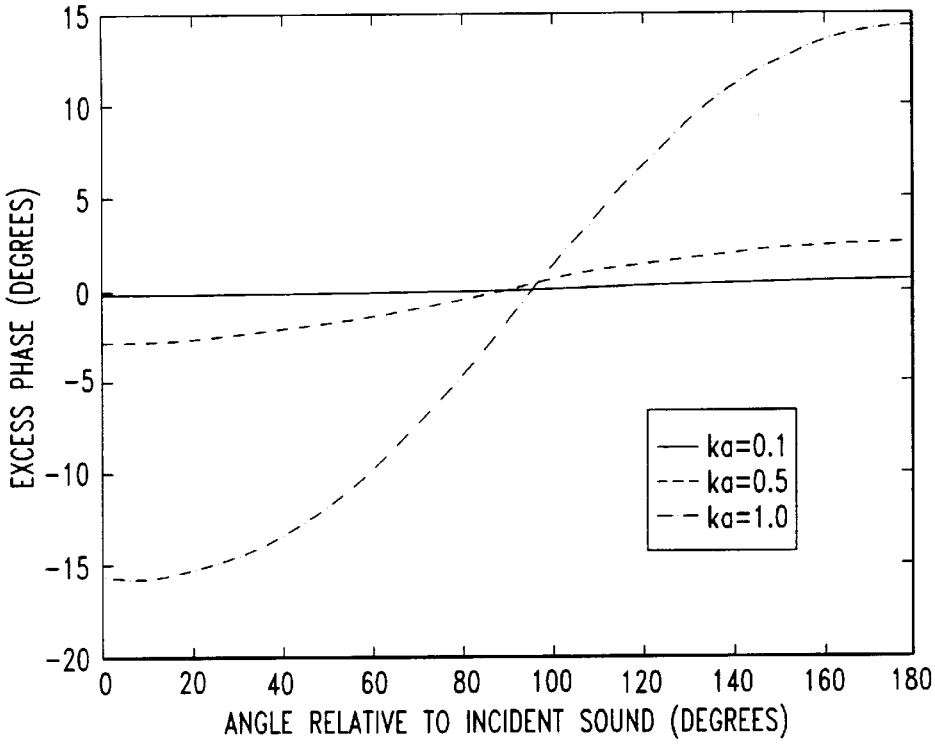
FIG. 17 shows the excess phase on the surface of a rigid sphere for plane wave incidence at $\theta=0°$ for ka=0.1, 0.5, and 1.0.

FIGS. 16 and 17 show the normalized acoustic pressure (i.e., normalized to the incident acoustic pressure amplitude) and the excess phase on the surface of the illustrative sphere for plane wave incidence at $\theta=0°$, respectively. The data is shown for three different values of the quantity (ka)—namely, for ka=0.1, 0.5, and 1.0. The excess phase is calculated as the difference in phase at points on the rigid sphere and the phase for a freely propagating wave measured at the same spatial location. In effect, the excess phase is the perturbation in the phase due to the rigid sphere. From calculations of the scattering and diffraction from the rigid sphere, it is possible to investigate the effects of the sphere on the directivity of the synthesized first-order microphone.

Figure 18:
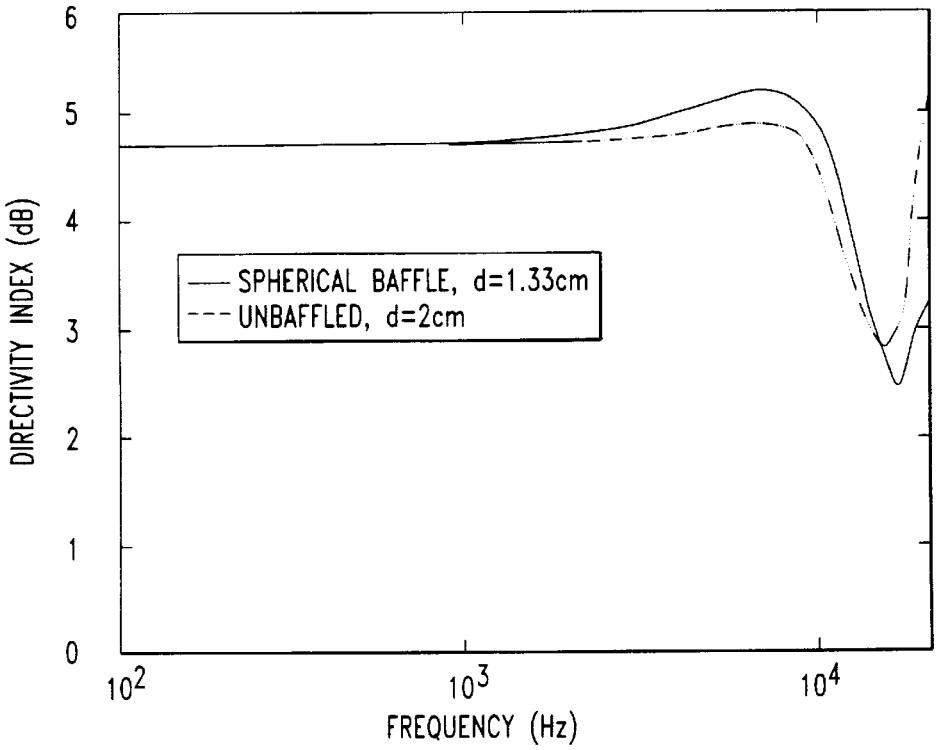
FIG. 18 shows illustrative directivity indices for an unbaffled and spherically baffled cardioid microphone array in accordance with illustrative embodiments of the present invention.
Figure 19A:
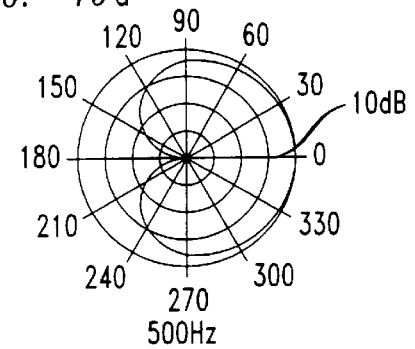
Figure 19A:
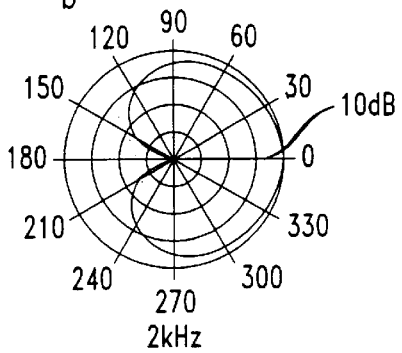
Figure 19A:
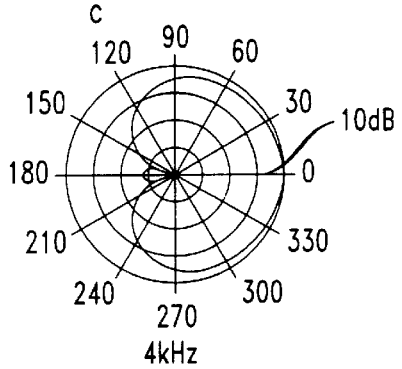
Figure 19A:
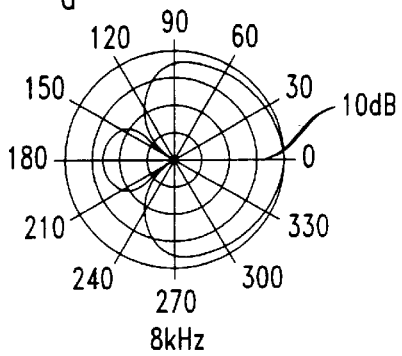
Figure 20A:
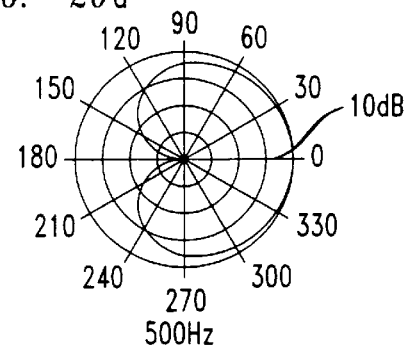
Figure 20A:
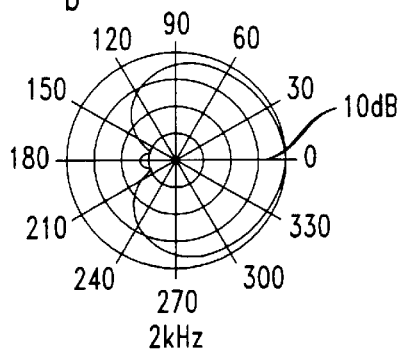
Figure 20A:
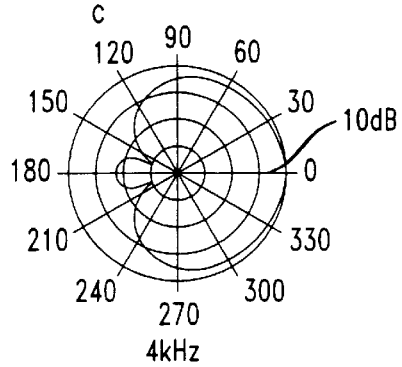
Figure 20A:
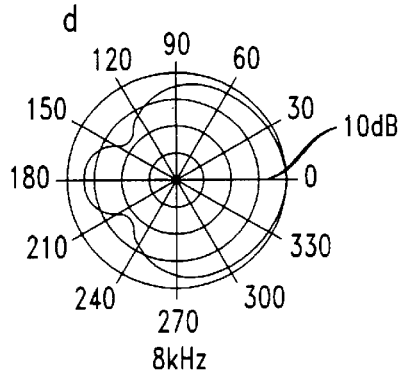

FIG. 18 shows illustrative directivity indices of a free-space (dashed line) and a spherically baffled (solid line) array of six omnidirectional microphones for a cardioid derived response, in accordance with two illustrative embodiments of the present invention. The derived cardioid is "aimed" along one of the three dipole axes. (The actual axis chosen is not important.) Note that the spherical baffle diameter has been advantageously chosen to be 1.33 cm (¾"*⅔) while the unbaffled spacing is 2 cm (approximately ¾). The reason for these different dimensions is that the scattering and diffraction from the spherical baffle makes the effective distance between the microphones 50 percent larger, as described above. Therefore, a 1.33 cm diameter spherically baffled array is comparable to an unbaffled array with 2 cm spacing. As can be seen in FIG. 18, the effect of the baffle on the derived cardioid steered along a microphone axis pair is to slightly increase the directivity index at high frequencies. The increase of the directivity index becomes noticeable at approximately 1 kHz. The value of the quantity (ka) at 1 kHz for 2 cm element spacing is approximately 0.2.

FIGS. 19A–19D show illustrative directivity patterns in the $\phi$-plane for the unbaffled synthesized cardioid microphone in accordance with an illustrative embodiment of the present invention for 500 Hz, 2 kHz, 4 kHz, and 8 kHz, respectively. The spacing between elements for the illustrative patterns shown in FIGS. 19A–19D is 2 cm. Note that as the frequency increases, the beamwidth decreases, corresponding to the increase in the directivity index shown in FIG. 18. The small pattern narrowing can most easily be seen at the angle where $\phi=120°$.

FIGS. 20A–20D show illustrative directivity patterns of the synthesized cardioid using a 1.33 cm diameter rigid sphere baffle in accordance with an illustrative embodiment of the present invention at 500 Hz, 2 kHz, 4 kHz, and 8 kHz, respectively. The narrowing of the beampattern as the frequency increases can easily be seen in these figures. This trend is consistent with the results shown in FIG. 18, where the directivity index of the baffled system is shown to increase more substantially than that of the unbaffled microphone system.

Figure 21:
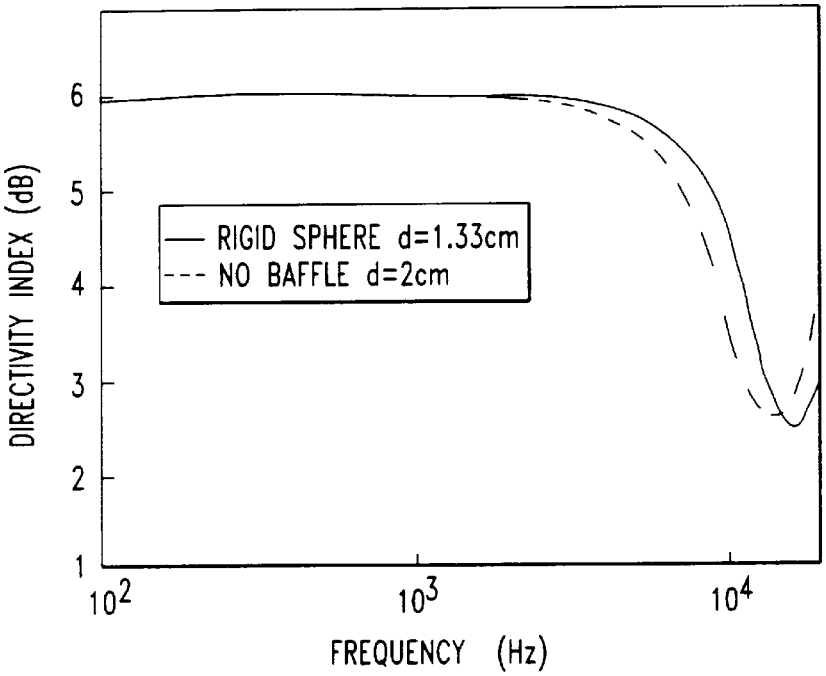
FIG. 21 shows illustrative directivity index results for a derived hypercardioid in accordance with an illustrative embodiment of the present invention, steered along one of the dipole axes.

FIG. 21 shows illustrative directivity index results for a derived hypercardioid in accordance with an illustrative embodiment of the present invention, steered along one of the dipole axes. The directivity indices are shown for an illustrative unbaffled hypercardioid microphone (dashed line), and for an illustrative spherically baffled hypercardioid microphone (solid line), each in accordance with an illustrative embodiment of the present invention. The net result of the spherical baffle can be seen in this case to sustain the directivity index of the derived hypercardioid over a slightly larger frequency region. The hypercardioid pattern has the maximum directivity index for all first-order differential microphones. The pattern is obtained by choosing $\alpha=0.25$ as the weighting in Equation (1).

V. An Illustrative DSP Microphone Array Implementation

In accordance with one illustrative embodiment of the present invention, a DSP (Digital Signal Processor) implementation may be realized on a Signalogic Sig32C DSP-32C PC DSP board. The Sig32C board advantageously has eight independent A/D and D/A channels, and the input A/Ds are 16 bit Crystal CS-4216 oversampled sigma-delta converters so that the digitally derived anti-aliasing filters are advantageously identical in all of the input channels. The A/D and D/A converters can be externally clocked, which is particularly advantageous since the sampling rate is set by the dimensions of the spherical probe. In other illustrative embodiments, other DSP or processing environments may be used.

As was shown above, when a rigid sphere baffle is used, the time delay between an opposing microphone pair is 1.5 times the diameter of the sphere. In accordance with one illustrative embodiment of the present invention, the microphone probe is advantageously constructed using a 0.75 inch diameter nylon sphere. This particular size for the spherical baffle advantageously enables the frequency response of the microphone to exceed 5 kHz, and advantageously enables the spherical baffle to be constructed from existing materials. Nylon in particular is an easy material to machine and spherical nylon bearings are easy to obtain. In other illustrative embodiments, other materials and other shapes and sizes may be used.

Figure 22:
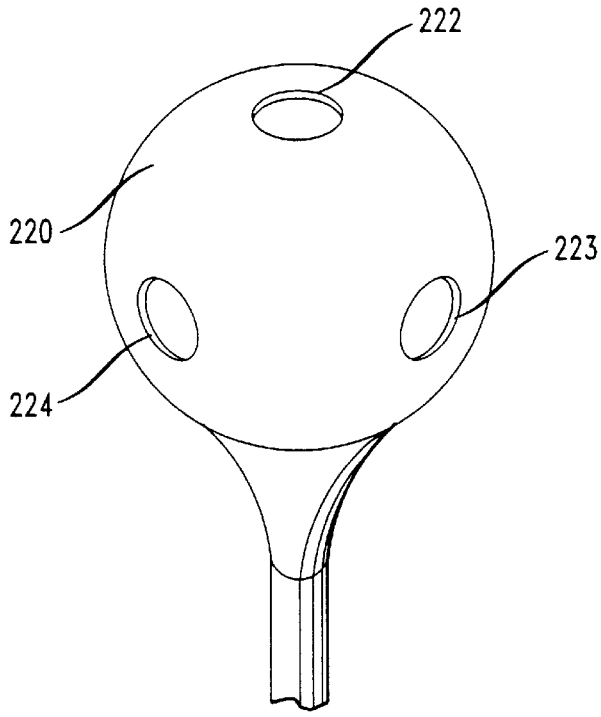
FIG. 22 shows an illustration of a 6-element microphone array mounted in a 0.75 inch nylon sphere in accordance with an illustrative embodiment of the present invention.

For a spherical baffle of 0.75 inch (1.9 cm) diameter, the time delay between opposing microphones is 83.31 microseconds. The sampling rate corresponding to a period of 83.31 microseconds is 12.003 kHz. By fortuitous coincidence, this sampling rate is one of the standard rates that is selectable on the Sig32C board. An illustration of a microphone array mounted in a rigid 0.75 inch nylon sphere in accordance with one illustrative embodiment of the present invention is shown in FIG. 22. Note that only 3 microphone capsules can be seen in the figure (i.e., microphones 221, 222, and 223), with the remaining three microphone elements being hidden on the back side of the sphere. All six microphones are advantageously mounted in ¾ inch nylon sphere 220, located on the surface at points where an included regular octahedron's vertices would contact the spherical surface.

The individual microphone elements may, for example, be Sennheiser KE4-211 omnidirectional elements. These microphone elements advantageously have an essentially flat frequency response up to 20 kHz—well beyond the designed operational frequency range of the differential microphone array. In other embodiments of the present invention, other conventional omnidirectional microphone elements may be used.

Figure 23:
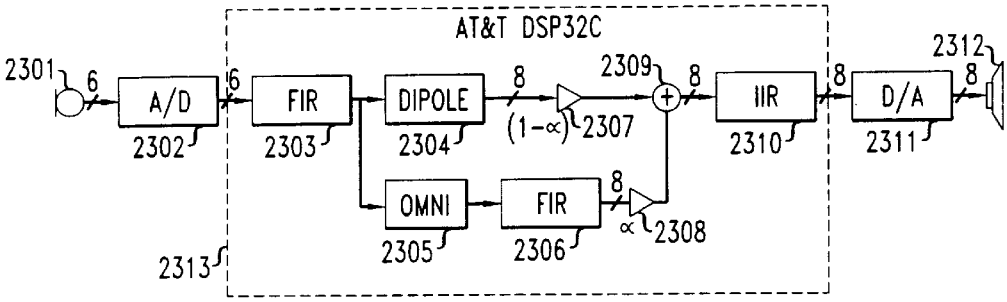
FIG. 23 shows a block diagram of DSP processing used to form a steerable first-order differential microphone in accordance with an illustrative embodiment of the present invention.

A functional block diagram of a DSP realization of the steerable first-order differential microphone in accordance with one illustrative embodiment of the present invention is shown in FIG. 23. Specifically, the outputs of microphones 2301 (of which there are 6) are provided to A/D converters 2302 (of which there are 6, corresponding to the 6 microphones) to produce (6) digital microphone signals. These digital signals may then be provided to processor 2313, which, illustratively, comprises a Lucent Technologies DSP32C. Within the DSP, (6) finite-impulse-response filters 2303 filter the digital microphone signals and provide the result to both dipole signal generators 2304 (of which there are 8) and omni signal generators 2305 (of which there are also 8). The omni signal generators are filtered by (8) corresponding finite-impulse-response filters 2306, and the results are multiplied by (8) corresponding amplifiers 2308, each having a gain of $\alpha$ (see the analysis above). Similarly, the (8) outputs of the dipole signal generators are multiplied by (8) corresponding amplifiers 2307, each having a gain of $1-\alpha$ (see the analysis above). The outputs of the two sets of amplifiers are then combined into eight resultant signals by (8) adders 2309, the outputs of which are filtered by (8) corresponding infinite-impulse-response filters 2310. This produces the eight channel outputs of the DSP, which are then converted back to analog signals by (8) corresponding D/A converters 2311 and which may then, for example, be provided to (8) loudspeakers 2312.

The illustrative three-dimensional vector probe described herein is a true gradient microphone. In particular, and in accordance with an illustrative embodiment of the present invention, the gradient is estimated by forming the differences between closely-spaced pressure microphones. The gradient computation then involves the combination of all of the microphones. Thus, it is advantageous that all of the microphones be closely calibrated to each other. In accordance with an illustrative embodiment of the present invention, therefore, correcting each microphone with a relatively short length FIR (finite-impulse-response) filter advantageously enables the use of common, inexpensive pressure-sensitive microphones (such as, for example, common electret condenser pressure microphones). A DSP program may be easily written by those skilled in the art to adaptively find the appropriate Weiner filter (familiar to those skilled in the art) between each microphone and a reference microphone positioned near the microphone. The Weiner (FIR) filters may then be used to filter each microphone channel and thereby calibrate the microphone probe. Since, in accordance with the presently described embodiment of the present invention, there are eight independent output channels, the DSP program may be advantageously written to allow for eight general first-order beam outputs that can be steered to any direction in $4\pi$ space. Since all of the dipole and cardioid signals are employed for a single channel, there is not much overhead in adding additional output channels.

Figure 24:
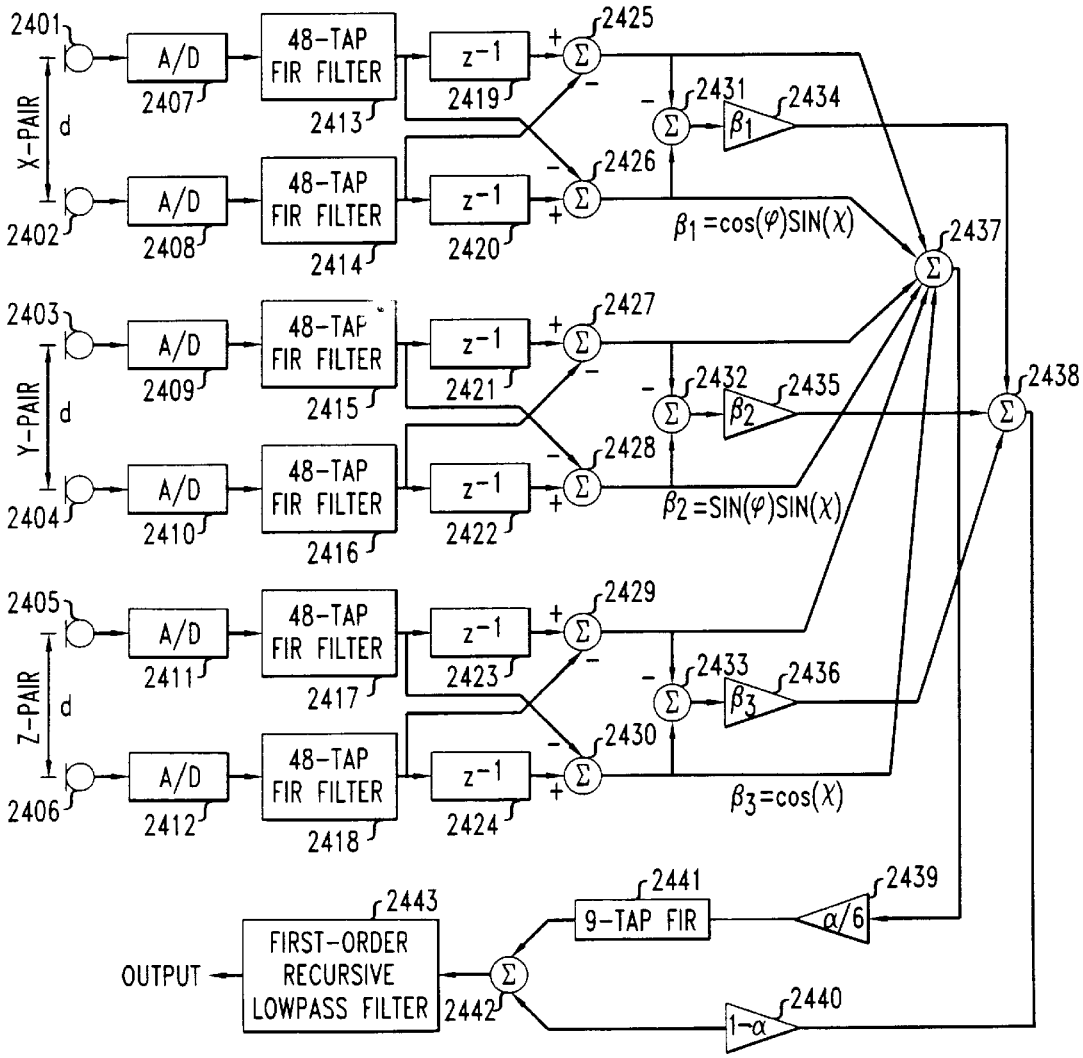
FIG. 24 shows a schematic diagram of an illustrative DSP implementation for one beam output of the illustrative realization shown in FIG. 23.

FIG. 24 shows a schematic diagram of an illustrative DSP implementation for one beam output (i.e., an illustrative derivation of one of the eight output signals produced by DSP 2313 in the illustrative DSP realization shown in FIG. 23). The addition of each additional output channel requires only the further multiplication of the existing omnidirectional and dipole signals and a single pole IIR (infinite-impulse-response) lowpass correction filter.

Specifically, microphones 2401 and 2402 comprise the x-pair (for the x-axis), microphones 2403 and 2404 comprise the y-pair (for the y-axis), and microphones 2405 and 2406 comprise the z-pair (for the z-axis). The output signals of each of these six microphones are first converted to digital signals by A/D converters 2407–2412, respectively, and are then filtered by 48-tap finite-impulse-response filters 2413–2418, respectively. Delays 2419–2424 and subtractors 2425–2430 produce the individual signals which are summed by adder 2437 to produce the omni signal. Meanwhile, subtractors 2431, 2432, and 2433, amplifiers 2434, 2335, and 2436 (having gains $\beta_1=\cos(\phi)\sin(\chi)$, $\beta_2=\sin(\chi)\sin(\chi)$, and $\beta_3=\cos(\chi)$, respectively—see above), and adder 2438, produce the dipole signal. The omni signal is multiplied by amplifier 2439 (having gain ($\alpha/6$—see above) and then filtered by 9-tap finite-impulse-response filter 2441. The dipole signal is multiplied by amplifier 2440 (having gain $1-\alpha$—see above), and the result is combined with the amplified and filtered omni signal by adder 2442. Finally, first-order recursive lowpass filter 2443 filters the sum formed by adder 2442, to produce the final output.

Figure 25:
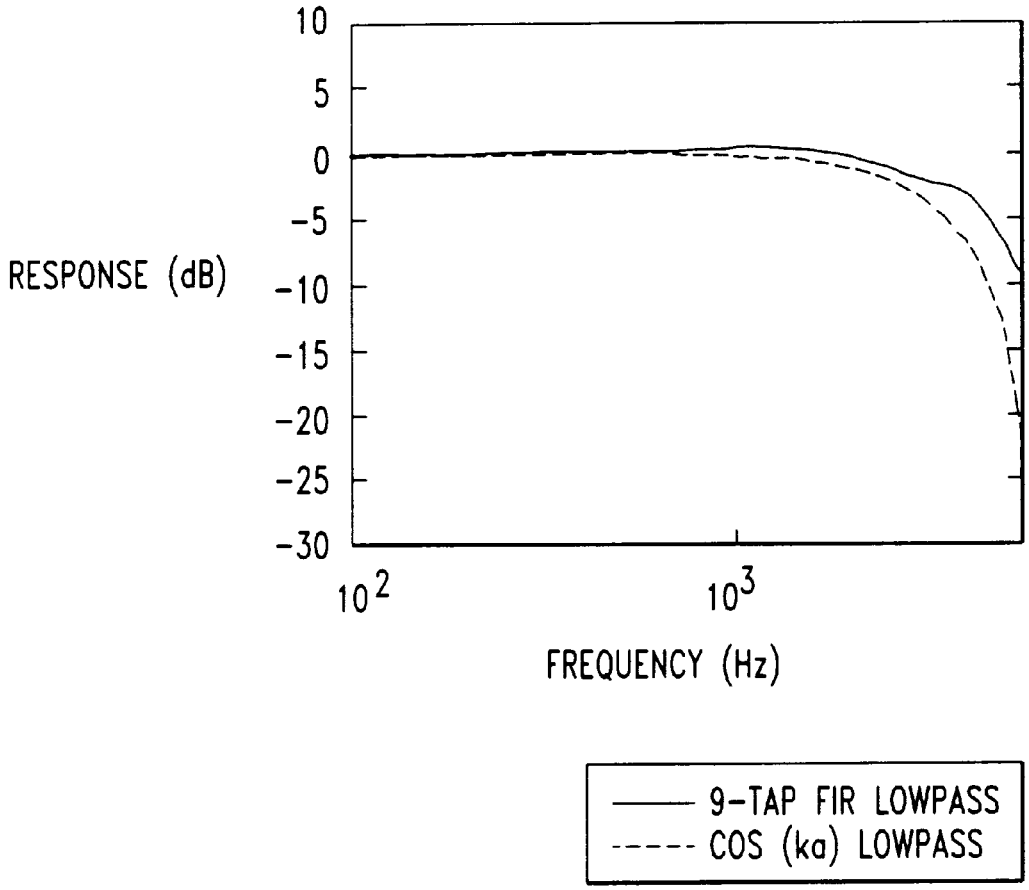
FIG. 25 shows a response of an illustrative lowpass filter used to compensate high frequency differences between the cardioid derived omnidirectional and dipole components in the illustrative implementation of FIG. 24, together with an illustrative response of a cos(ka) lowpass filter.

Note that the calibration FIR filters (i.e., 48-tap finite-impulse-response filters 2413–2418) may be advantageously limited to 48 taps to enable the algorithm to run in real-time on the illustrative Sig32C board equipped with a 50 MHz DSP-32C. In other illustrative embodiments longer filters may be used. The additional 9-tap FIR filter on the synthesized omnidirectional microphone (i.e., 9-tap finite-impulse-response filter 2441) is advantageously included in order to compensate for the high frequency differences between the cardioid-derived omnidirectional and dipole components. In particular, FIG. 25 shows the response of an illustrative 9-tap lowpass filter that may be used in the illustrative implementation of FIG. 24. Also shown in the figure is the cos(ka) lowpass that is the filtering of the cardioid-derived dipole signal relative to difference-derived dipole (see Equation (16) above).

For clarity of explanation, the illustrative embodiments of the present invention are partially presented as comprising individual functional blocks (including functional locks labeled as "processors"). The functions these blocks represent may be provided through the use of either shared or dedicated hardware, including, but not limited to, hardware capable of executing software. For example, the functions of processors presented herein may be provided by a single shared processor or by a plurality of individual processors. Moreover, use of the term "processor" herein, both in the detailed description and in the claims, should not be construed to refer exclusively to hardware capable of executing software. For example, illustrative embodiments may comprise digital signal processor (DSP) hardware, such as Lucent Technologies' DSP16 or DSP32C, read-only memory (ROM) for storing software performing the operations discussed above, and random access memory (RAM) for storing DSP results. Very large scale integration (VLSI) hardware embodiments, as well as custom VLSI circuitry in combination with a general purpose DSP circuit, may also be provided. Any and all of these embodiments may be deemed to fall within the meaning of the word "processor" as used herein, both in the detailed description and in the claims.

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

I claim:

1. A microphone array operating over a given audio frequency range, the microphone array comprising:

a plurality of individual pressure-sensitive microphones which generate a corresponding plurality of individual microphone output signals, each individual pressure-sensitive microphone having a substantially omnidirectional response pattern, the plurality of individual microphones comprising three or more individual microphones arranged in an N-dimensional spatial arrangement where N>1, the spatial arrangement locating each of said individual microphones at a distance from each of the other individual microphones which is smaller than a minimum acoustic wavelength defined by said audio frequency range of operation; and a processor adapted to compute a plurality of difference signals and an omni signal having a substantially omnidirectional response pattern, each difference signal comprising an algebraic difference between two of said individual microphone output signals corresponding to a pair of said individual microphones, the omni signal having an amplitude and a phase and comprising an additive aggregation of two or more of said individual microphone output signals, the processor further adapted to selectively weight each of said plurality of difference signals and said omni signal, and to produce a microphone array output signal based upon a combination of said selectively weighted difference signals and said selectively weighted omni signal, such that the microphone array output signal thereby has a steerable response pattern having an orientation of maximum reception based upon said selective weighting of said plurality of difference signals and said omni signal.

2. The microphone array of claim 1 wherein the plurality of individual microphones consists of three pressure-sensitive microphones arranged in a two-dimensional spatial arrangement.

3. The microphone array of claim 2 wherein the three pressure-sensitive microphones are located substantially at the vertices of an equilateral triangle.

4. The microphone array of claim 1 wherein the plurality of individual microphones consists of four pressure-sensitive microphones arranged in a two-dimensional spatial arrangement.

5. The microphone array of claim 4 wherein the four pressure-sensitive microphones are located substantially at the vertices of a square.

6. The microphone array of claim 1 wherein the plurality of individual microphones consists of four pressure-sensitive microphones arranged in a three-dimensional spatial arrangement.

7. The microphone array of claim 6 wherein the four pressure-sensitive microphones are located substantially at the vertices of a regular tetrahedron.

8. The microphone array of claim 1 wherein the plurality of individual microphones consists of six pressure-sensitive microphones arranged in a three-dimensional spatial arrangement.

9. The microphone array of claim 8 wherein the six pressure-sensitive microphones are located substantially at the vertices of a regular octahedron.

10. The microphone array of claim 9 wherein the six microphones are mounted on the surface of a substantially rigid sphere.

11. The microphone array of claim 10 wherein said sphere is made substantially of nylon.

12. The microphone array of claim 11 wherein the diameter of said sphere is approximately ¾".

13. The microphone array of claim 1 wherein said processor comprises a DSP.

14. The microphone array of claim 1 wherein said microphone array output signal is further based on a substantially omnidirectional signal generated based on each of said individual microphone output signals.

15. The microphone array of claim 14 wherein the substantially omnidirectional signal is filtered by a lowpass filter.

16. The microphone array of claim 14 wherein said microphone array output signal comprises a weighted combination of said substantially omnidirectional signal and said combination of said selectively weighted difference signals.

17. The microphone array of claim 16 wherein said weighted combination of said substantially omnidirectional signal and said combination of said selectively weighted difference signals is filtered by a lowpass filter to produce said microphone array output signal.

18. The microphone array of claim 1 wherein each of the individual microphone output signals is filtered by a finite-impulse-response filter.

19. The microphone array of claim 18 wherein each of the individual microphone output signals is filtered by a finite-impulse-response filter having at least 48 taps.

20. A method for generating a microphone array output signal with a steerable response pattern, the method comprising the steps of:

receiving a plurality of individual microphone output signals generated by a corresponding plurality of individual pressure-sensitive microphones, each individual pressure-sensitive microphone having a substantially omnidirectional response pattern, the plurality of individual microphones comprising three or more individual microphones arranged in an N-dimensional spatial arrangement where N>1, the spatial arrangement locating each of said individual microphones at a distance from each of the other individual microphones which is smaller than a minimum acoustic wavelength defined by a given audio frequency range of operation;

computing a plurality of difference signals and an omni signal having a substantially omnidirectional response pattern, each difference signal comprising an algebraic difference between two of said individual microphone output signals corresponding to a pair of said individual microphones and the omni signal having an amplitude and a phase and comprising an additive aggregation of two or more of said individual microphone output signals;

selectively weighting each of said plurality of difference signals and said omni signal and generating a combination thereof; and generating said microphone array output signal based upon said combination of said selectively weighted difference signals and said selectively weighted omni signal, such that the microphone array output signal thereby has a steerable response pattern having an orientation of maximum reception based upon said selective weighting of said plurality of difference signals and said omni signal.

21. The method of claim 20 wherein the step of generating said microphone array output signal comprises generating a substantially omnidirectional signal based on each of said individual microphone output signals, and wherein said microphone array output signal is further based on said substantially omnidirectional signal.

22. The method of claim 21 wherein the step of generating said microphone array output signal further comprises filtering said substantially omnidirectional signal with a lowpass filter.

23. The method of claim 21 wherein the step of generating said microphone array output signal further comprises generating a weighted combination of said substantially omnidirectional signal and said combination of said selectively weighted difference signals.

24. The method of claim 23 wherein the step of generating said microphone array output signal further comprises filtering said weighted combination of said substantially omnidirectional signal and said combination of said selectively weighted difference signals with a lowpass filter.

25. The method of claim 20 further comprising the step of filtering each of the individual microphone output signals with a finite-impulse-response filter.

26. The method of claim 25 wherein the step of filtering each of the individual microphone output signals with a finite-impulse-response filter comprises filtering each of the individual microphone output signals with a finite-impulse-response filter having at least 48 taps.

* * * * *